US008960331B2

(12) United States Patent
Yambao et al.

(10) Patent No.: US 8,960,331 B2
(45) Date of Patent: Feb. 24, 2015

(54) WIRED OR PORTED UNIVERSAL JOINT FOR DOWNHOLE DRILLING MOTOR

(75) Inventors: Neal S. Yambao, Beaumont (CA); Dan A. Marson, Sherwood Park (CA)

(73) Assignee: Weatherford/Lamb, Inc., Houston, TX (US)

( * ) Notice: Subject to any disclaimer, the term of this patent is extended or adjusted under 35 U.S.C. 154(b) by 391 days.

(21) Appl. No.: 13/411,535

(22) Filed: Mar. 3, 2012

(65) Prior Publication Data

US 2013/0228381 A1 Sep. 5, 2013

(51) Int. Cl.
*E21B 4/00* (2006.01)

(52) U.S. Cl.
USPC ..... 175/107; 175/104

(58) Field of Classification Search
USPC ..... 166/107, 92, 100
See application file for complete search history.

(56) References Cited

U.S. PATENT DOCUMENTS

| | | | | |
|---|---|---|---|---|
| 4,157,022 | A | 6/1979 | Crase | |
| 4,772,246 | A | 9/1988 | Wenzel | |
| 4,904,228 | A * | 2/1990 | Frear et al. | 464/152 |
| 4,982,801 | A | 1/1991 | Zitka et al. | |
| 5,000,723 | A | 3/1991 | Livingstone | |
| 5,048,622 | A | 9/1991 | Ide | |
| 5,160,925 | A | 11/1992 | Dailey et al. | |
| 5,205,789 | A | 4/1993 | Falgout, Sr. | |
| 5,267,905 | A | 12/1993 | Wenzel et al. | |
| 5,288,271 | A | 2/1994 | Nelson et al. | |
| 5,520,256 | A | 5/1996 | Eddison | |
| 5,704,838 | A | 1/1998 | Teale | |
| 5,725,061 | A * | 3/1998 | Van Steenwyk et al. | 175/104 |
| 6,392,561 | B1 | 5/2002 | Davies et al. | |
| 6,540,032 | B1 | 4/2003 | Krueger | |
| 6,949,025 | B1 | 9/2005 | Kraus et al. | |
| 7,186,182 | B2 | 3/2007 | Wenzel et al. | |
| 7,303,007 | B2 | 12/2007 | Konschuh et al. | |
| 7,624,819 | B1 | 12/2009 | LeBlanc et al. | |
| 7,708,086 | B2 | 5/2010 | Witte | |

(Continued)

FOREIGN PATENT DOCUMENTS

| | | |
|---|---|---|
| RU | 2162520 C1 | 1/2001 |
| RU | 2236583 C1 | 9/2004 |

(Continued)

OTHER PUBLICATIONS

Copending U.S. Appl. No. 131974,257, filed Aug. 23, 2013.

(Continued)

*Primary Examiner* — Brad Harcourt
*Assistant Examiner* — Steven MacDonald
(74) *Attorney, Agent, or Firm* — Wong, Cabello, Lutsch, Rutherford & Brucculeri LLP

(57) ABSTRACT

A bottom hole assembly for a drill string has a mud motor and a mandrel. The motor has a rotor and a stator, and the rotor defines a bore for passage of conductors. The mandrel has a bore for passage of the conductors and for drilling fluid, and rotation of the mandrel rotates a drill bit. A shaft and universal joints covert orbital motion at the rotor to rotational motion at the mandrel. To pass the conductors from a sonde uphole of the motor to electronics disposed with the mandrel, an inner beam disposes in a bore of the shaft. This inner beam has an internal passage for the conductors, and seal caps dispose on each end of the inner beam to seal inside the universal joints. The inner beam and seal caps prevent drilling fluid passing from the motor and around the shaft from communicating in the shaft's bore.

25 Claims, 5 Drawing Sheets

(56) References Cited

U.S. PATENT DOCUMENTS

| | | | | |
|---|---|---|---|---|
| 7,766,098 | B2 | 8/2010 | Farley | |
| 7,832,503 | B2 * | 11/2010 | Sand et al. | 175/107 |
| 8,033,917 | B2 | 10/2011 | Prill et al. | |
| 8,342,970 | B2 | 1/2013 | Altimas et al. | |
| 2009/0275415 | A1 | 11/2009 | Prill et al. | |
| 2010/0190561 | A1 | 7/2010 | Falgout, Jr. et al. | |

FOREIGN PATENT DOCUMENTS

| | | | |
|---|---|---|---|
| RU | 2239042 | C1 | 10/2004 |
| RU | 2401931 | C1 | 10/2010 |

OTHER PUBLICATIONS

Computalog Drilling Services, "6¾" Oil Lube—SDB Series," dated Oct. 31, 2005.

First Examination Report in counterpart Australian Appl. 2013200954, dated Jul. 21, 2014.

First Office Action in counterpart Canadian Appl. 2,805,990, dated Jul. 31, 2014.

Decision on Grant in counterpart Russian Appl. 2013107896, dated Mar. 14, 2014.

* cited by examiner

WIRED OR PORTED UNIVERSAL JOINT FOR DOWNHOLE DRILLING MOTOR

BACKGROUND

In borehole geophysics, a wide range of parametric borehole measurements can be made, including chemical and physical properties of the formation penetrated by the borehole, as well as properties of the borehole and material therein. Measurements are also made to determine the path of the borehole during drilling to steer the drilling operation or after drilling to plan details of the borehole. To measure parameters of interest as a function of depth within the borehole, a drill string can convey one or more logging-while-drilling (LWD) or measurement-while-drilling (MWD) sensors along the borehole so measurements can be made with the sensors while the borehole is being drilled.

As shown in FIG. 1A, a drill string 30 deploys in a borehole 12 from a drilling rig 20 and has a bottom hole assembly 40 disposed thereon. The rig 20 has draw works and other systems to control the drill string 30 as it advances and has pumps (not shown) that circulate drilling fluid or mud through the drill string 30. The bottom hole assembly 40 has an electronics section 50, a mud motor 60, and an instrument section 70. Drilling fluid flows from the drill string 30 and through the electronics section 50 to a rotor-stator element in the mud motor 60. Powered by the pumped fluid, the motor 60 imparts torque to the drill bit 34 to rotate the bit 34 and advance the borehole 12. The drilling fluid exits through the drill bit 34 and returns to the surface via the borehole annulus. The circulating drilling fluid removes drill bit cuttings from the borehole 12, controls pressure within the borehole 12, and cools the drill bit 34.

Surface equipment 22 having an uphole telemetry unit (not shown) can obtain sensor responses from one or more sensors in the assembly's instrument section 70. When combined with depth data, the sensor responses can form a log of one or more parameters of interest. Typically, the surface equipment 22 and electronics section 50 transfer data using telemetry systems known in the art, including mud pulse, acoustic, and electromagnetic systems.

Shown in more detail in FIG. 1B, the electronics section 50 couples to the drill string 30 with a connector 32. The electronic section 50 contains an electronics sonde 52 and allows for mud flow therethough. The sonde 52 includes a downhole telemetry unit 58, a power supply 54, and various sensors 56. Connectors 42/44 couple the mud motor 60 to the electronics section 50, and the connector 42 has a telemetry terminus that electrically connects to elements in the sonde 52.

Mud flows from the drill string 30, through the electronic section 50, through the connectors 42/44 and to the mud motor 50, which has a rotor 64 and a stator 62. The downhole flowing drilling fluid rotates the rotor 64 within the stator 62. In turn, the rotor 64 connects by a flex shaft 66 to a drive shaft 72 supported by bearings 68. The flex shaft 66 transmits power from the rotor 64 to the drive shaft 72.

Disposed below the mud motor 60, the instrument section 70 has one or more sensors 74 and electronics 76 to control the sensors 74. A power supply 78, such as a battery, can power the sensors 74 and electronics 76 if power is not supplied from sources above the mud motor 60. The drill bit (34; FIG. 1A) couples to a bit box 36, and the one or more sensors 74 are placed as near to the drill bit (34) as possible for better measurements. Sensor responses are transferred from the sensors 74 to the downhole telemetry unit 58 disposed above the mud motor 60. In turn, the sensor responses are telemetered uphole by the unit 58 to the surface, using mud pulse, electromagnetic, or acoustic telemetry.

Because the instrument section 70 is disposed in the bottom hole assembly 40 below the mud motor 60, the rotational nature of the mud motor 60 presents obstacles for connecting to the downhole sensors 74. As shown, the sensors 74 are hard wired to the electronics section 50 using conductors 46 disposed within the rotating elements of the mud motor 60. In particular, the conductors 46 connect to the sensor 74 and electronics 76 at a lower terminus 48*a* and extend up through the drive shaft 72, flex shaft 66, and rotor 64. Eventually, the conductors 46 terminate at an upper terminus 48*b* within the mud motor connector 44. As with the lower terminus, this upper terminus 48*b* rotates as do the conductors 46.

Running conductors 46 through the flex shaft 66 creates difficulties with sealing and can be expensive to implement. FIG. 2 shows a prior art arrangement for hard wiring through a mud motor 60 between downhole components (sensors, power supply, electronics, etc.) and uphole components (processor, telemetry unit, etc.). The flex shaft 66 is shown for connecting the motor output from the rotor 64 to the drive shaft 72 supported by bearings 68. The flex shaft 66 has a reduced cross-section so it can flex laterally while maintaining longitudinal and torsional rigidity to transmit rotation from the mud motor 60 to the drill bit (not shown). A central bore 67 in the flex shaft 66 provides a clear space to accommodate the conductors 46.

The flex shaft 66 is elongated and has downhole and uphole adapters 69*a-b* disposed thereon. The shaft 66 and adapters 69*a-b* each define the bore 67 so the conductors 46 used for power and/or communications can pass through them. The adapters 69*a-b* typically shrink or press with an interference fit to the ends of the shaft 66.

Down flowing drilling fluid from the stator 62 and rotor 64 passes in the annular space around the shaft 66 and adapters 69*a-b*. The shrink fitting of the adapters 69*a-b* to the shaft 66 creates a fluid tight seal that prevents the drilling fluid from passing into the shaft's bore 67 at the adapters 69*a-b*. A port 69*c* toward the downhole adapter 69*a* allows the drilling fluid to enter a central bore 73 of the drive shaft 72 so the fluid can be conveyed to the drill bit (not shown).

The flex shaft 66 has to be long enough to convert the orbital motion of the rotor 64 into purely rotational motion for the drive shaft 72 while being able to handle the required torque, stresses, and the like. Moreover, the flex shaft 66 has to be composed of a strong material having low stiffness in order to reduce bending stresses (for a given bending moment) and also to minimize the side loads placed on the surrounding radial bearings 68. For this reasons, the elongated flex shaft 66 is typically composed of titanium and can be as long as 4.5 to 5 feet. Thus, the shaft 66 can be quite expensive and complex to manufacture. Moreover, the end adaptors 69*a-b* shrink fit onto ends of the shaft 66 to create a fluid tight seal to keep drilling fluid out of the internal bore 67 in the shaft 66. Although the shrink fit of the adapters 69*a-b* avoids sealing issues, this arrangement can be expensive and complex to manufacture and assemble.

The subject matter of the present disclosure is directed to overcoming, or at least reducing the effects of, one or more of the problems set forth above.

SUMMARY

A bottom hole assembly for a drill string has a mud motor, a mandrel, and a transmission section. The mud motor has a rotor and a stator, and the rotor defines a rotor bore for passage of one or more conductors. The mandrel has a bore for passage of the conductors and for drilling fluid, and rotation of the mandrel rotates a drill bit. Drilling fluid pumped down the drill string passes through the mud motor and causes the rotor to orbit within the stator. The drilling fluid passes the transmission section and enters a port in the mandrel bore so the drilling fluid can be delivered to drill bit on the mandrel.

A shaft in the transmission section has a bore and coverts the orbital motion at the mud motor to rotational motion at the mandrel. The shaft couples at a first end to the rotor with a first universal joint and couples at a second end to the mandrel with a second universal joint. An inner conduit or beam disposes in the shaft's bore. The shaft can be composed of alloy steel, while the inner conduit or beam can be composed of titanium.

This inner beam has an internal passage therethrough for communicating the conductors between opposing ends. These opposing ends seal inside passages of the universal joints. In particular, seal caps dispose on each of the ends of the inner beam and seal inside the passages of the universal joints. In this way, drilling fluid passing from the mud motor and around the transmission shaft is sealed from communicating in the bore of the shaft around the inner beam having the conductors.

For their part, the universal joints can each have a joint member coupled to the rotor and can have a socket receiving an end of the shaft therein. At least one bearing disposes in a bearing pocket in the end of the shaft, and at least one bearing slot in the socket receives the at least one bearing. To hold the bearing, a retaining ring can dispose about the end of the shaft adjacent the socket in the joint member.

The mandrel below the motor section can have an electronic device, such as a sensor, associated therewith. The conductors electrically couple to the electronic device and pass from the bore of the mandrel, through the inner passage of the inner beam, and to the bore of the rotor. For example, the conductors can pass from a sensor disposed with the mandrel to a sonde disposed above the mud motor. The sensor can be a gamma radiation detector, a neutron detector, an inclinometer, an accelerometer, an acoustic sensor, an electromagnetic sensor, a pressure sensor, or a temperature sensor. The conductors can be one or more single strands of wire, a twisted pair, a shielded multi-conductor cable, a coaxial cable, and an optical fiber.

The foregoing summary is not intended to summarize each potential embodiment or every aspect of the present disclosure.

DETAILED DESCRIPTION

Figure 1A:
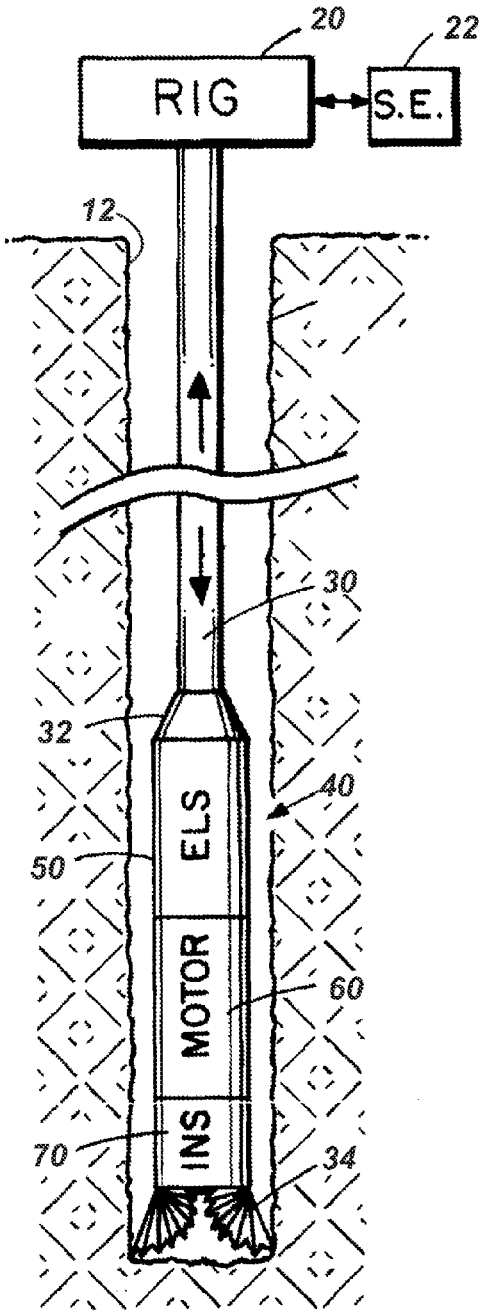
Fig. 1A (Prior Art)
FIG. 1A conceptually illustrates a prior art drilling system disposed in a borehole.
Figure 1B:
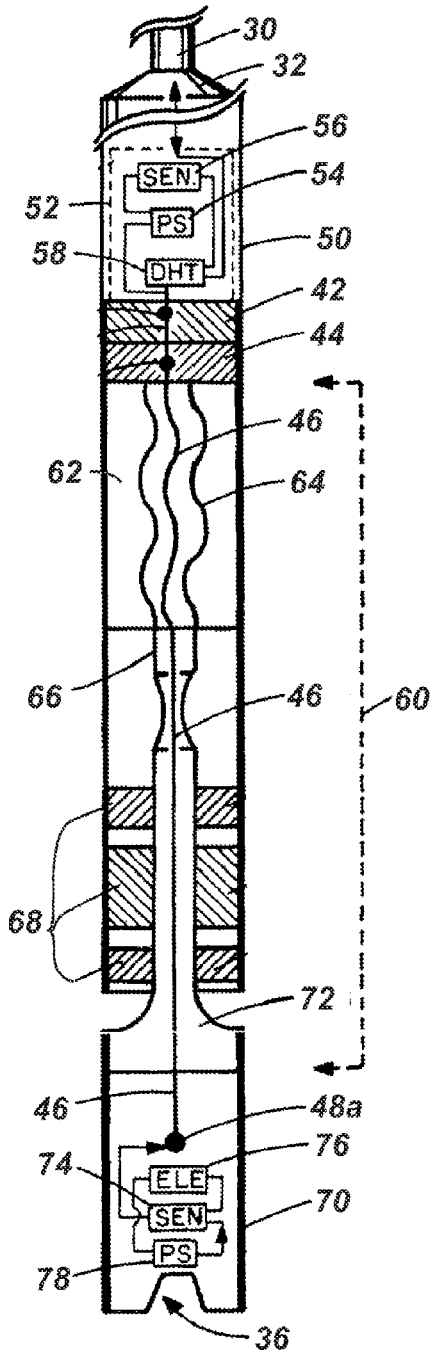
Fig. 1B (Prior Art)
FIG. 1B illustrates a prior art bottom hole assembly in more detail.
Figure 2:
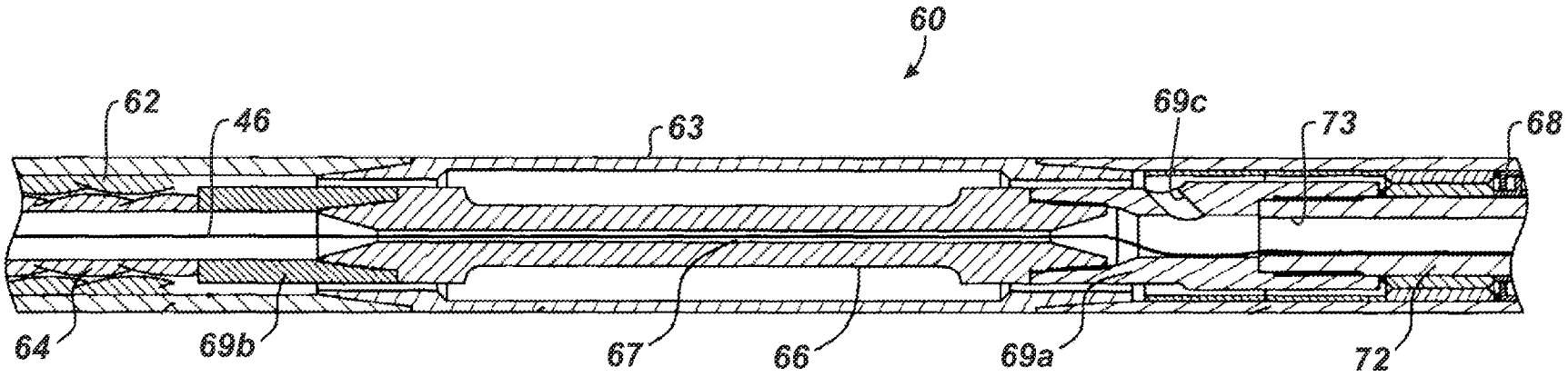
Fig. 2 (Prior Art)
FIG. 2 shows a flex shaft with conductors passing therethrough.
Figure 3:
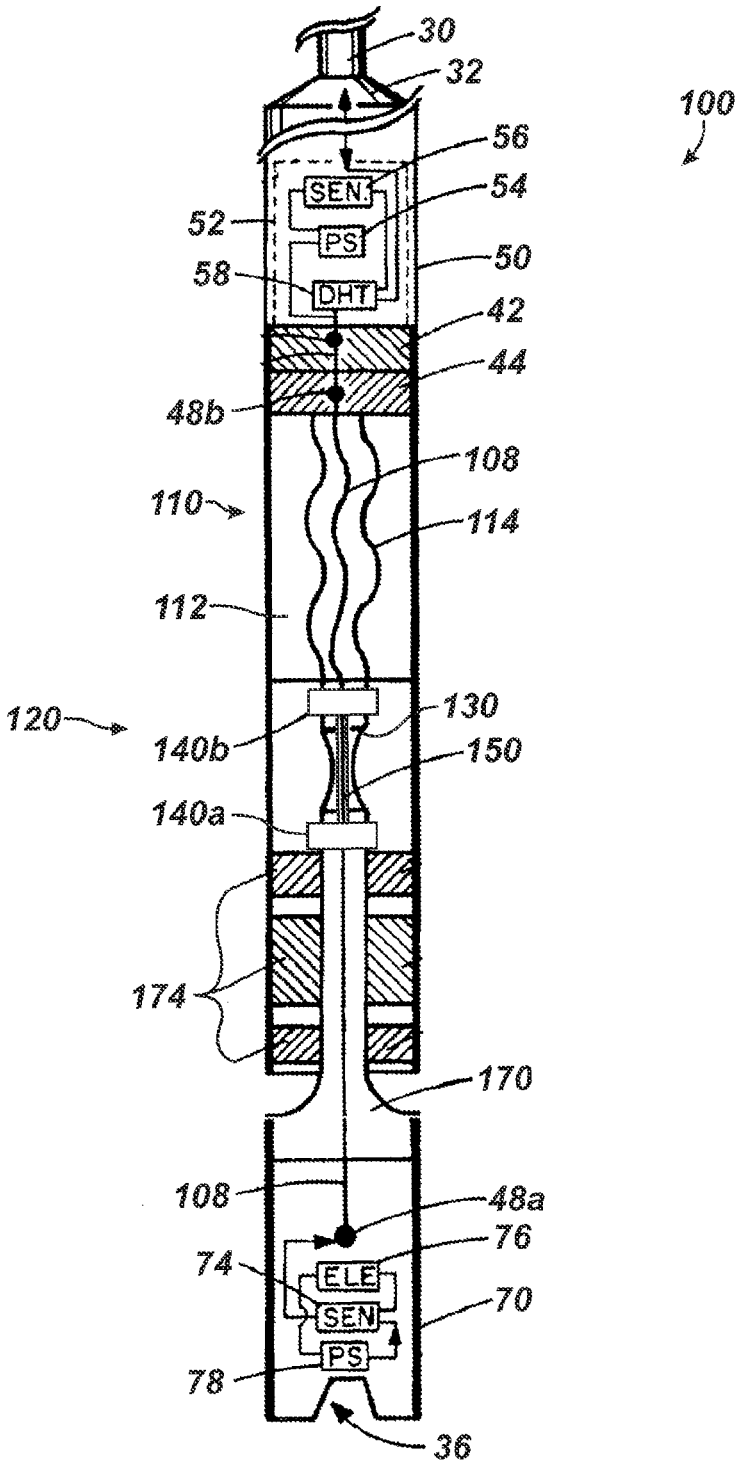
FIG. 3 conceptually illustrates a bottom hole assembly according to the present disclosure.

A bottom hole assembly 100 according to the present disclosure conceptually illustrated in FIG. 3 connects to a drill string 30 with a connector 32 and deploys in a borehole from a drilling rig (not shown). The bottom hole assembly 100 has an electronics section 50, a mud motor section 110, a transmission section 120, and an instrument section 70. A drill bit (not shown) disposes at the bit box connection 36 on the end of the assembly 100 so the borehole can be drilled during operation.

The electronics section 50 is similar to that described previously and includes an electronics sonde 52 having a power supply 54, sensors 56, and a downhole telemetry unit 58. Disposed below the electronics section 50, the mud motor section 110 has a stator 112 and a rotor 114. Drilling fluid from the drill string 30 flows through the downhole telemetry connector 42 and the mud motor connector 44 to the mud motor section 110. Here, the downhole flowing drilling fluid rotates the rotor 114 within the stator 112. In turn, the rotor 114 connects by a transmission shaft 130 to a mandrel or drive shaft 170 supported by bearings 174, and the transmission shaft 130 transmits power from the rotor 114 to the drive shaft 170.

The instrument section 70 is disposed below the transmission section 120. The instrumentation section 70 is also similar to that described previously and includes one or more sensors 74, an electronics package 76, and an optional power supply 78. (Because a conductor conduit 108 has conductors that can provide electrical power, the power source 78 may not be required within the instrument section 70.) The one or more sensors 74 can be any type of sensing or measuring device used in geophysical borehole measurements, including gamma radiation detectors, neutron detectors, inclinometers, accelerometers, acoustic sensors, electromagnetic sensors, pressure sensors, temperature sensors, and the like.

The one or more sensors 74 respond to parameters of interest during drilling. For example, the sensors 74 can obtain logging and drilling parameters, such as direction, RPM, weight/torque on bit and the like as required for the particular drilling scenario. In turn, sensor responses are transferred from the sensors 74 to the downhole telemetry unit 58 disposed above the mud motor section 60 using the conductor conduit 108. A number of techniques can be used to transmit the sensor responses across the connectors 42/44, including techniques disclosed in U.S. Pat. No. 7,303,007, which is incorporated herein by reference in its entirety. In turn, the sensor responses are telemetered uphole by the unit 58 to the surface, using mud pulse, electromagnetic, or acoustic telemetry. Conversely, information can be transferred from the surface through an uphole telemetry unit and received by the downhole telemetry unit 58. This "down-link" information can be used to control the sensors 40 or to control the direction in which the borehole is being advanced.

Because the instrument section 70 is disposed in the bottom hole assembly 100 below the mud motor section 110, the rotational nature of the mud motor section 110 presents obstacles for connecting the telemetry unit 58, power supply 54, and the like to the downhole sensors 74 below the mud motor section 110.

To communicate sensor response, convey power, and the like, the conductor conduit 108 disposes within the rotating elements of the bottom hole assembly 100 and has one or more conductors that connect the sonde 52 to the instrument section 70 and to other components. As shown in FIG. 3, for example, the sensor 74 and electronics 76 electrically connect to a lower terminus 48*a* of conductors in the conduit 108. These conductors in the conduit 108 can be single strands of wire, twisted pairs, shielded multi-conductor cable, coaxial cable, optical fiber, and the like.

The conductor conduit 108 extends from the lower terminus 48*a* and pass through the mandrel or drive shaft 170, the transmission section 120, and the motor section's rotor 114. Eventually, the conductor conduit 108 terminates at an upper terminus 48*b* within the mud motor connector 44. As with the lower terminus, this upper terminus 48*b* rotates as does the conductor conduit 108. Various fixtures, wire tensioning assemblies, rotary electrical connections, and the like (not shown) can be used to support the conductor conduit 108 and their passage through the bottom hole assembly 100.

As shown in FIG. 3, the transmission section 120 has a transmission shaft 130 coupled between upper and lower universal joints 140*a-b*. The transmission shaft 130 and the universal joints 140*a-b* interconnect the motor section's rotor 114 to the drive shaft 170 and convert the orbital motion at the rotor 114 to rotational motion at the drive shaft 170. The conductor conduit 108 also passes through the transmission shaft 130 and the universal joints 140*a-b* as they interconnect the downhole sensors 74 to the uphole components (e.g., telemetry unit 58, power supply 54, etc.).

Figure 4:
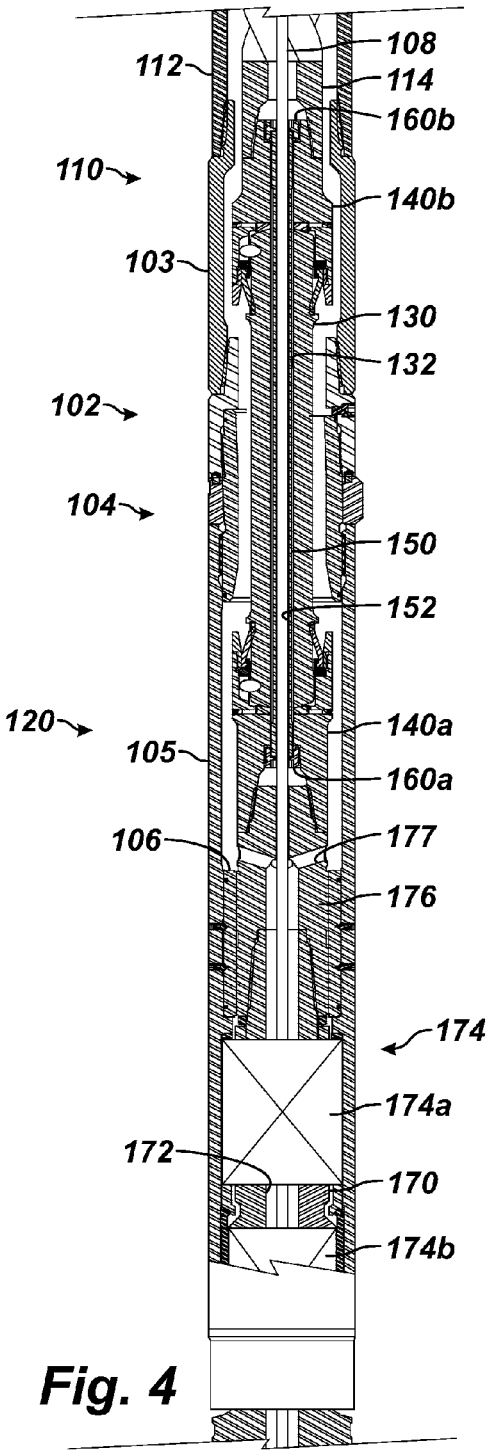
FIG. 4 shows portion of a bottom hole assembly having a transmission section according to the present disclosure.
Figure 5:
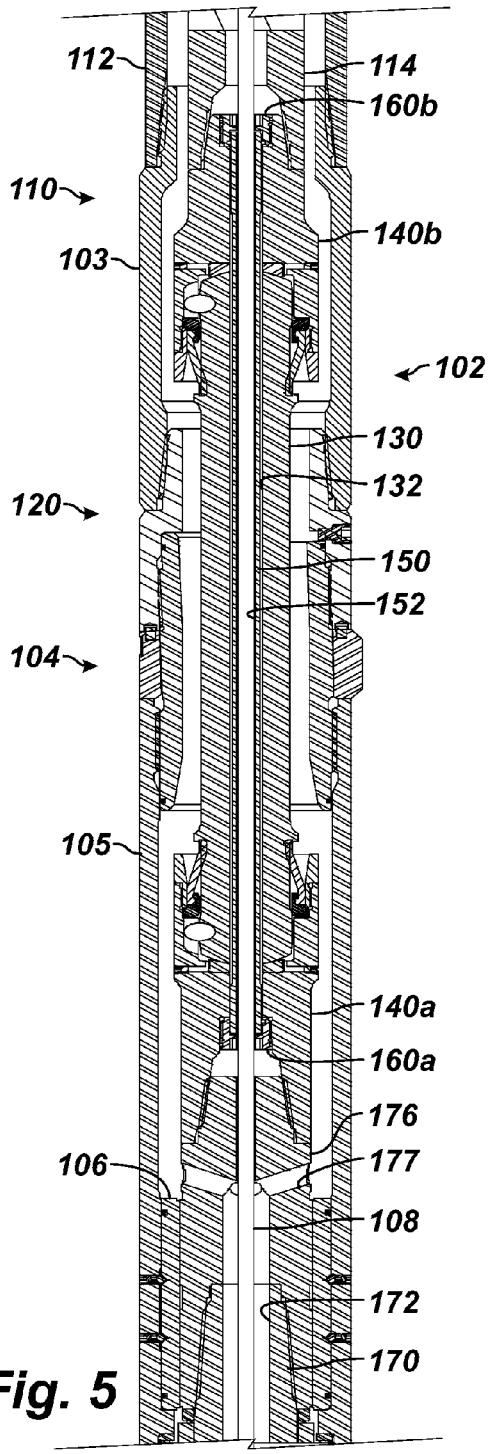
FIG. 5 shows portion of the bottom hole assembly of FIG. 4 in more isolated detail.

Further details of the transmission section 120 are best shown in FIGS. 4 and 5. As shown, the housing 102 at the transmission section 120 has a number of interconnected housing components to facilitate assembly and provide a certain bend. For example, the housing 102 has a stator housing adapter 103 that couples to the stator 112. An adjustable assembly 104 connects between the adapter 103 and a transmission housing 105. This adjustable assembly 104 provide the drilling motor with a certain bend capability.

The conductor conduit 108 passes from the uphole components (e.g., telemetry unit, power supply, etc.), through the rotor 114, through the arrangement of upper universal joint 140*b*, transmission shaft 130, lower universal joint 140*a*, and to the drive shaft 170. The conductor conduit 108 continues through the bore 172 of the drive shaft 170 to downhole components (e.g., sensors, electronics, etc.).

Downhole flowing fluid rotates the rotor 114 within the stator 112. In turn, the rotor 114 connects to the transmission shaft 130, which transfers the orbital motion at the rotor 114 to rotational motion at the mandrel or drive shaft 170. At the downhole end of the assembly 100, a bearing assembly 174 supports the drive shaft 170. The bearing assembly 174 provides radial and axial support of the drive shaft 170. As shown in FIG. 4, for example, the bearing assembly 174 has bearings 174*a* for axial support and bearings 174*b* for radial support. Although diagrammatically shown, the bearing assembly 174 can have conventional ball bearings, journal bearings, PDC bearings, or the like. In turn, the drive shaft 170 couples to the other components of the bottom hole assembly 100 including the drill bit.

After passing the rotor 114 and stator 112, the downward flowing fluid passes around the transmission shaft 130 and universal joints 140*a-b*. An end connector 176 connects the drive shaft 170 to the lower universal joint 140*a*. This connector 176 has ports 177 that let the drilling fluid from around the transmission shaft 130 to pass into the drive shaft 170, where the fluid can continue on to the drill bit (not shown). A flow restrictor 106 disposes around this connector 176 in the space with the transmission housing 106 to restrict flow between the transmission section 120 and the bearing assembly 174.

Figure 6A:
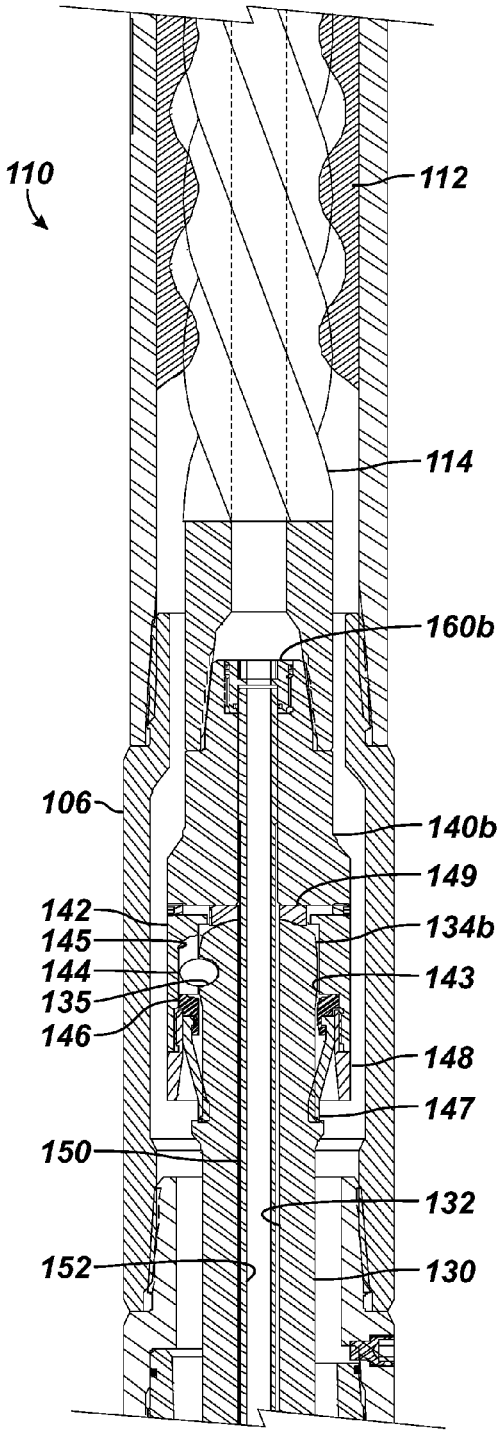
FIG. 6A shows the uphole coupling of the transmission section of FIG. 5 in detail.
Figure 6B:
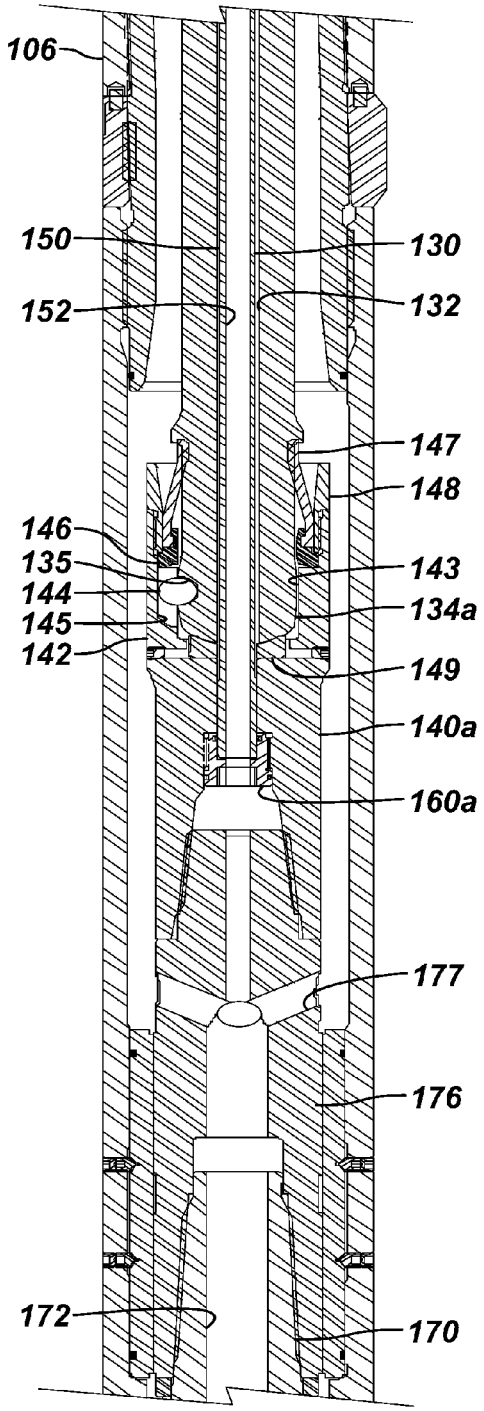
FIG. 6B shows the downhole coupling of the transmission section of FIG. 5 in detail.

Discussion now turns to FIGS. 6A-6B showing the uphole and downhole couplings of the transmission shaft 130 in detail without the conductor conduit (108) passing therethrough. The transmission shaft 130 has downhole and uphole ends 134*a-b* coupled to the universal joint adapters 140*a-b*. The universal joint adapters 140*a-b* can take a number of forms. In the present arrangement, for example, each of these adapters 140*a-b* includes a joint member 142 having a socket 143 in which the end 134*a-b* of the shaft 130 disposes. Thrust seats 149 are provided between the ends 134*a-b* and the sockets 143. One or more bearings 144 dispose in bearing pockets 135 in the end 134*a-b* of the shaft 130 and slide into one or bearing slots 145 in the socket 143 of the joint member 142. A retaining split ring 146 disposes about the end of the shaft 130 adjacent the socket 143 and connects to the joint member 142. In addition, a seal boot 147 connects from the split ring 146 to the shaft 130 to keep drilling fluid from entering and to balance pressure for lubrication oil in the drive to the internal pressure of the drilling motor. A seal collar 148 then holds the seal assembly on the joint member 142.

During rotation, the universal joint adapters 140*a-b* transfer rotation between the transmission shaft 130 and the rotor 114 and the mandrel or drive shaft 170. Yet, the universal joint adapters 140*a-b* allow the connection with the transmission shaft's ends 134*a-b* to articulate during the rotation. In this way, the transmission shaft 130 can convert the orbital motion at the rotor 114 into purely rotational motion at the drive shaft 170.

To convey the conductor conduit (108) from the rotor 114 to the instrumentation section below the drive shaft 170, the transmission shaft 130 defines a through-bore 132. To deal with fluid sealing at the connection of the shaft's ends 134*a-b* to the universal joint adapters 140*a-b*, an inner shaft or beam 150 having its own bore 152 installs in the transmission shaft's bore 132. As described below, the beam 150 helps seal passage of the conduit (108) through the universal joint adapters 140*a-b*, and the beam 150 flexes to compensate for eccentricity of the power section and any bend of the drilling motor.

To prepare the transmission section 120, operators mill the bore 132 through the transmission shaft 130. Operators then run the inner beam 150 down the bore 132 for sealing purposes. This inner beam 150 can be composed of alloy steel or titanium. Seal caps 160*a-b* dispose on opposing ends of the inner beam 150 and seal the connection between the adapters 140*a-b* and the inner beam 150. O-rings or other forms of sealing can be used on the seal caps 160*a-b* to seal against the shaft's bore 132 and the beam 150.

In later stages of assembly, operators run the conductor conduit (108) through this inner beam 150 and the seal caps 160*a-b*. Ultimately, the arrangement seals fluid from communicating through the bore 132 of the shaft 130. Although fluid may still pass through bore 152 of the beam 150 (e.g., up through connector 176), the shaft 130 and end caps 160*a-b* prevent fluid flow from the universal joints 140*a-b* from passing into the bore 132 and around the conductor conduit (108), which could damage the conduit (108).

The seal caps 160*a-b* can affix in the intermediate passages in the joint members 142 in a number of suitable ways. As shown, for example, the seal caps 160*a-b* can thread into the intermediate passages and can include O-rings or other seal elements. An internal ledge or shoulder in the seal cap 160*a-b* can retain the ends of the inner beam 150. As shown, the inner beam 150 preferably has an outer diameter along most of its length that is less than the inner diameter of the shaft's bore 132. This may allows for some flexure and play in the assembly. The ends of the inner beam 150, however, may fit more snuggly in the bore 132 to help with sealing.

Rather than transferring torque through interference fits, the universal joint adapters 140*a-b* transfer torque through their universal joint connections to the ends 134*a-b* of the transmission shaft 130. The inner beam 150 seals the passage 152 and bore 132 for the conductor conduit (108) from the drilling fluid. The outer transmission shaft 130 can be much smaller than the conventional flex shaft composed of titanium used in the art. Because the transmission section 120 has internal and external shafts 130/150 that rotate and orbit along their lengths during operation, the seal caps 160*a-b* handle issues with axial movement of the inner beam 150 at the seal caps 160*a-b* relative to the adapter socket members 142.

As opposed to the more expensive titanium conventionally used, the transmission shaft 130 can be composed of alloy steel or other conventional metal for downhole use, although the shaft 130 could be composed of titanium if desired. Moreover, the transmission shaft 130 can be shorter than the conventional length used for a flex shaft with shrunk fit adapters. In particular, the universal joint adapters 140*a-b* and their ability to convert the orbital motion of the rotor 114 into pure rotation at the drive shaft 170 enables the transmission shaft 130 to be shorter than conventionally used. In fact, in some implementations for a comparable motor application, the transmission shaft 130 can be about 2 to 3 feet in length as opposed to the 4 to 5 feet length required for a titanium flex shaft with shrunk fit adapters of the prior art. In addition to the shorter length, the transmission shaft can be composed of materials other than the conventional titanium. For example, the transmission shaft 130 can be composed of more conventional materials (e.g., alloy steel) and still be able to handle the torque and other forces experienced during operation.

As disclosed above, the transmission section 120 having external and internal shafts 130/150 and universal joints 140*a-b* can be used for a downhole mud motor to pass conductor conduit 108 to electronic components near the drill bit. Yet, the transmission section 120 can also find use in other applications. In one example, the inner beam 150 sealed inside the transmission shaft 130 and universal joints 140*a-b* can be used to convey any number of elements or components other than wire conductor conduit in a sealed manner between uphole and downhole elements of a bottom hole assembly. In fact, the transmission shaft 130 with its sealed inner beam 150 can allow fluid to communicate alternatively outside the external shaft 130 or inside the inner beam 150 in a sealed manner when communicated between a mud motor and a drive shaft. Thus, the disclosed arrangement of transmission shaft, inner conduit, and universal joint adapters can be useful for these and other applications.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A bottom hole assembly for a drill string, comprising:

a mud motor disposed on the drill string and having a rotor and a stator, the rotor defining a first bore;

a mandrel disposed downhole from the mud motor and defining a second bore;

a shaft defining a third bore and having first and second ends, the first end coupled to the rotor with a first universal joint, the second end coupled to the mandrel with a second universal joint; and an inner beam disposed in the third bore of the shaft, the inner beam having an internal passage and having third and fourth ends, the third end sealing communication of the internal passage past the first end of the shaft at the first universal joint with the first bore of the rotor, the fourth end sealing communication of the internal passage past the second end of the shaft at the second universal joint with the second bore of the mandrel.

2. The assembly of claim 1, wherein the first and second universal joints and the shaft convert orbital motion at the rotor to rotational motion at the mandrel.

3. The assembly of claim 1, further comprising at least one sensor disposed with the mandrel and operationally connected to one or more conductors, the one or more conductors passing from the second bore of the mandrel, through the inner passage of the inner beam, and to the first bore of the rotor.

4. The assembly of claim 1, wherein the first universal joint comprises a joint member coupled to the rotor and having a socket receiving the first end of the shaft therein.

5. The assembly of claim 4, wherein the first universal joint comprises at least one bearing disposed in a bearing pocket in the first end of the shaft and received in at least one bearing slot in the socket.

6. The assembly of claim 4, wherein the first universal joint comprises a retaining ring disposed about the first end of the shaft adjacent the socket in the joint member.

7. The assembly of claim 1, wherein the shaft is composed of an alloy steel, and wherein the inner beam is composed of titanium.

8. The assembly of claim 1, wherein each of the first and second universal joints comprise an intermediate passage, and wherein the assembly further comprises seal caps disposed on each of the third and fourth ends of the inner beam and sealing inside the intermediate passages.

9. The assembly of claim 1, wherein the inner beam is flexible at least at the third and fourth ends, the third end flexing between the first end of the shaft and the first universal joint, the fourth end flexing between the second end of the shaft and the second universal joint.

10. A bottom hole assembly for a drill string, comprising:

a mud motor having a rotor disposed in a stator, the rotor defining a first bore;

a first universal joint coupled to the rotor and having a first passage connected with the first bore;

a shaft having first and second ends and defining a second bore, the first end coupled to the first universal joint, the second bore connected with the first passage;

a second universal joint coupled to the second end of the shaft and having a second passage connected with the second bore;

a mandrel coupled to the second universal joint and having a third bore connected with the second passage; and an inner beam disposed in the second bore of the shaft, the inner beam having an internal passage and having third and fourth ends, the third end sealed in the first passage of the first universal joint past the first end of the shaft and sealing communication of the internal passage with the first bore of the rotor, the fourth end sealed in the second passage of the second universal joint past the second end of the shaft and sealing communication of the internal passage with the third bore of the mandrel.

11. The assembly of claim 10, wherein the first and second universal joints and the shaft convert orbital motion at the rotor to rotational motion at the mandrel.

12. The assembly of claim 10, further comprising at least one sensor disposed with the mandrel and operationally connected to one or more conductors, the one or more conductors passing from the third bore of the mandrel, through the inner passage of the inner beam, and to the first bore of the rotor.

13. The assembly of claim 10, wherein the first universal joint comprises a joint member coupled to the rotor and having a socket receiving the first end of the shaft therein.

14. The assembly of claim 13, wherein the first universal joint comprises at least one bearing disposed in a bearing pocket in the first end of the shaft and received in at least one bearing slot in the socket.

15. The assembly of claim 13, wherein the first universal joint comprises a retaining ring disposed about the first end of the shaft adjacent the socket in the joint member.

16. The assembly of claim 10, wherein the shaft is composed of an alloy steel, and wherein the inner beam is composed of titanium.

17. The assembly of claim 10, further comprising seal caps disposed on each of the third and fourth ends of the inner beam and sealing inside the first and second passages of the first and second universal joints.

18. The assembly of claim 10, wherein the inner beam is flexible at least at the third and fourth ends, the third end flexing between the first end of the shaft and the first universal joint, the fourth end flexing between the second end of the shaft and the second universal joint.

19. The assembly of claim 10, wherein the mandrel is disposed on the bottom hole assembly downhole of the shaft, and wherein a bearing supports the mandrel in the bottom hole assembly.

20. A bottom hole assembly for a drill string, comprising:

a mud motor disposed on the drill string and having a rotor and a stator, the rotor defining a first bore for passage of at least one conductor;

a mandrel disposed downhole from the mud motor and having a second bore for passage of the at least one conductor;

at least one electronic device associated with the mandrel and electrically coupled to the at least one conductor;

a shaft defining a third bore and converting orbital motion at the mud motor to rotational motion at the mandrel, the shaft coupled at a first end to the rotor with a first universal joint and coupled at a second end to the mandrel with a second universal joint; and an inner beam disposed in the third bore of the shaft and having an internal passage for communicating the at least one conductor between third and fourth ends, the third end sealed past the first end of the shaft inside a first passage of the first universal joint, the fourth end sealed past the second end of the shaft inside a second passage of the second universal joint.

21. The assembly of claim 20, wherein the at least one electronic device comprises a sensor selected from the group consisting of a gamma radiation detector, a neutron detector, an inclinometer, an accelerometer, an acoustic sensor, an electromagnetic sensor, a pressure sensor, and a temperature sensor.

22. The assembly of claim 20, wherein the mandrel defines a port communicating an annulus space around the shaft in the assembly with the second bore of the mandrel.

23. The assembly of claim 20, further comprising a sonde disposed uphole of the mud motor and electrically connected to the at least one conductor.

24. The assembly of claim 20, wherein the at least one conductor is selected from the group consisting of one or more single strands of wire, a twisted pair, a shielded multi-conductor cable, a coaxial cable, and an optical fiber.

25. The assembly of claim 20, wherein the inner beam is flexible at least at the third and fourth ends, the third end flexing between the first end of the shaft and the first universal joint, the fourth end flexing between the second end of the shaft and the second universal joint.

* * * * *